US010934131B2

(12) United States Patent
Krishnamurthy et al.

(10) Patent No.: US 10,934,131 B2
(45) Date of Patent: Mar. 2, 2021

(54) ROPELESS ELEVATOR CONTROL SYSTEM

(71) Applicant: Otis Elevator Company, Farmington, CT (US)

(72) Inventors: Shashank Krishnamurthy, Glastonbury, CT (US); Vladimir Blasko, Avon, CT (US); Enrico Manes, Feeding Hills, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 744 days.

(21) Appl. No.: 15/548,221

(22) PCT Filed: Feb. 4, 2016

(86) PCT No.: PCT/US2016/016562

§ 371 (c)(1),
(2) Date: Aug. 2, 2017

(87) PCT Pub. No.: WO2016/126939

PCT Pub. Date: Aug. 11, 2016

(65) Prior Publication Data

US 2018/0009631 A1 Jan. 11, 2018

Related U.S. Application Data

(60) Provisional application No. 62/112,452, filed on Feb. 5, 2015.

(51) Int. Cl.
*B66B 1/32* (2006.01)
*B66B 9/02* (2006.01)
(Continued)

(52) U.S. Cl.
CPC ..... *B66B 1/32* (2013.01); *B66B 1/3461* (2013.01); *B66B 1/3492* (2013.01); *B66B 5/06* (2013.01);
(Continued)

(58) Field of Classification Search
CPC ..... B66B 1/32; B66B 1/3461; B66B 1/3492; B66B 5/06; B66B 5/16; B66B 9/00; B66B 9/02; B66B 9/003
(Continued)

(56) References Cited

U.S. PATENT DOCUMENTS 4,833,386 A * 5/1989 Unsworth ..... H02P 3/18 318/729
4,978,897 A * 12/1990 Merrison ..... H02P 27/026 318/268
(Continued)

FOREIGN PATENT DOCUMENTS

CN 101056813 A 10/2007
CN 101081676 A 12/2007
(Continued)

OTHER PUBLICATIONS

International Search Report and Written Opinion for application PCT/US2016/016562, dated May 11, 2016, 12pgs.
(Continued)

*Primary Examiner* — David S Warren
(74) *Attorney, Agent, or Firm* — Cantor Colburn LLP

(57) ABSTRACT

A ropeless elevator system 10 includes a lane 13, 15, 17. One or more cars 20 are arranged in the lane. At least one linear motor 38, 40 is arranged along one of the lane and the one or more cars, and a magnet 50, 60 is arranged along the other of the lane and the one or more cars. The at least one magnet is responsive to the at least one linear motor. A linear motor controller 70 is operatively connected to the at least one linear motor, and a lane controller 80 is operatively connected to the linear motor controller. A back electro-motive force (EMF) module 84 is operatively connected to at least one of the linear motor controller and the lane controller. The lane controller being configured and disposed to control stopping one of the one or more cars based on a back EMF
(Continued)

signal from the at least one linear motor determined by the EMF module.

18 Claims, 2 Drawing Sheets

(51) Int. Cl.
*B66B 1/34* (2006.01)
*B66B 5/06* (2006.01)
*B66B 5/16* (2006.01)
*B66B 9/00* (2006.01)
*B66B 11/04* (2006.01)

(52) U.S. Cl.
CPC ..... *B66B 5/16* (2013.01); *B66B 9/00* (2013.01); *B66B 9/02* (2013.01); *B66B 9/003* (2013.01); *B66B 11/0407* (2013.01)

(58) Field of Classification Search
USPC ..... 187/247
See application file for complete search history.

(56) References Cited

U.S. PATENT DOCUMENTS 5,121,016 A * 6/1992 Wachi ..... G11B 7/08529 310/12.01
5,799,755 A * 9/1998 Wan ..... B66B 9/003 187/403
7,335,071 B1 * 2/2008 Motsenbocker ..... B63H 23/30 440/1
7,896,135 B2 * 3/2011 Kattainen ..... B66B 1/30 187/248
8,072,166 B2 * 12/2011 Takeuchi ..... H02K 21/16 310/179
8,096,387 B2 * 1/2012 Kattainen ..... B66B 1/30 187/248
2003/0007148 A1 * 1/2003 Moon ..... G01J 3/02 356/328
2005/0205362 A1 * 9/2005 Morris ..... B66B 13/08 187/316
2008/0246424 A1 * 10/2008 Takeuchi ..... H02K 21/16 318/400.17
2009/0167218 A1 * 7/2009 Kallioniemi ..... H02P 3/18 318/379
2010/0032246 A1 * 2/2010 Kattainen ..... B66B 1/30 187/305
2010/0038185 A1 * 2/2010 Kattainen ..... B66B 1/30 187/288
2010/0231147 A1 * 9/2010 Milesi ..... H02P 6/24 318/375
2010/0315025 A1 * 12/2010 Yundt ..... H02P 21/36 318/375
2011/0158614 A1 * 6/2011 Cheng ..... H02P 3/04 388/800
2012/0098469 A1 * 4/2012 Takeuchi ..... H02K 41/031 318/135
2015/0188309 A1 * 7/2015 Lee ..... B60L 3/0061 361/25
2015/0191327 A1 * 7/2015 Rogers ..... B66B 1/30 187/276
2015/0263655 A1 * 9/2015 Foye ..... H02P 6/12 318/400.21
2015/0349686 A1 * 12/2015 Stoeger ..... H02P 29/0241 318/696
2016/0134207 A1 * 5/2016 Bock ..... H01H 89/00 318/771
2016/0137459 A1 * 5/2016 Rodriguez ..... B66B 11/0407 187/250
2017/0247222 A1 * 8/2017 Nagarajan ..... B66B 5/027
2018/0009631 A1 * 1/2018 Krishnamurthy ..... B66B 1/3461
2018/0016114 A1 * 1/2018 Nagarajan ..... B66B 1/28
2019/0025375 A1 * 1/2019 Bock ..... G01R 31/44
2020/0024105 A1 * 1/2020 Lampinen ..... B66B 1/32

FOREIGN PATENT DOCUMENTS

CN 101528577 A 9/2009
CN 101588979 A 11/2009
CN 102892698 A 1/2013
CN 104167896 A 11/2014
JP H0597353 A 4/1993
JP H06263366 A 9/1994
JP 3329873 B2 9/2002

OTHER PUBLICATIONS

Chinese First Office Action and Search Report for application CN 201680008771.2, dated Oct. 31, 2018, U320316CN, 9 pages.

* cited by examiner

ROPELESS ELEVATOR CONTROL SYSTEM

BACKGROUND OF THE INVENTION

Exemplary embodiments pertain to the art of elevator systems and, more particularly, to a ropeless elevator control system.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single lane. There exist ropeless elevator systems in which a first lane is designated for upward traveling elevator cars and a second lane is designated for downward traveling elevator cars. A transfer station at each end of the hoistway is used to move cars horizontally between the first lane and second lane. It is desirable to monitor operational states of each car to control traffic in the first and second lanes.

BRIEF DESCRIPTION OF THE INVENTION

Disclosed is a ropeless elevator system including a lane. One or more cars are arranged in the lane. At least one linear motor is arranged along one of the lane and on the one or more cars and a magnet is arranged along the other of the lane and the one or more cars. The at least one magnet is responsive to the at least one linear motor. A linear motor controller is operatively connected to the at least one linear motor, and a lane controller is operatively connected to the linear motor controller. A back electro-motive force (EMF) module is operatively connected to at least one of the linear motor controller and the lane controller. The lane controller being configured and disposed to control stopping of at least one of the one or more cars based on a back EMF signal from the at least one linear motor determined by the back EMF module.

Also disclosed is a method of controlling a ropeless elevator system including determining a back electro-motive force (EMF) signal from at least one linear motor arranged along one of an elevator lane and on an elevator car, and stopping the elevator car in the lane based on the back EMF signal.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
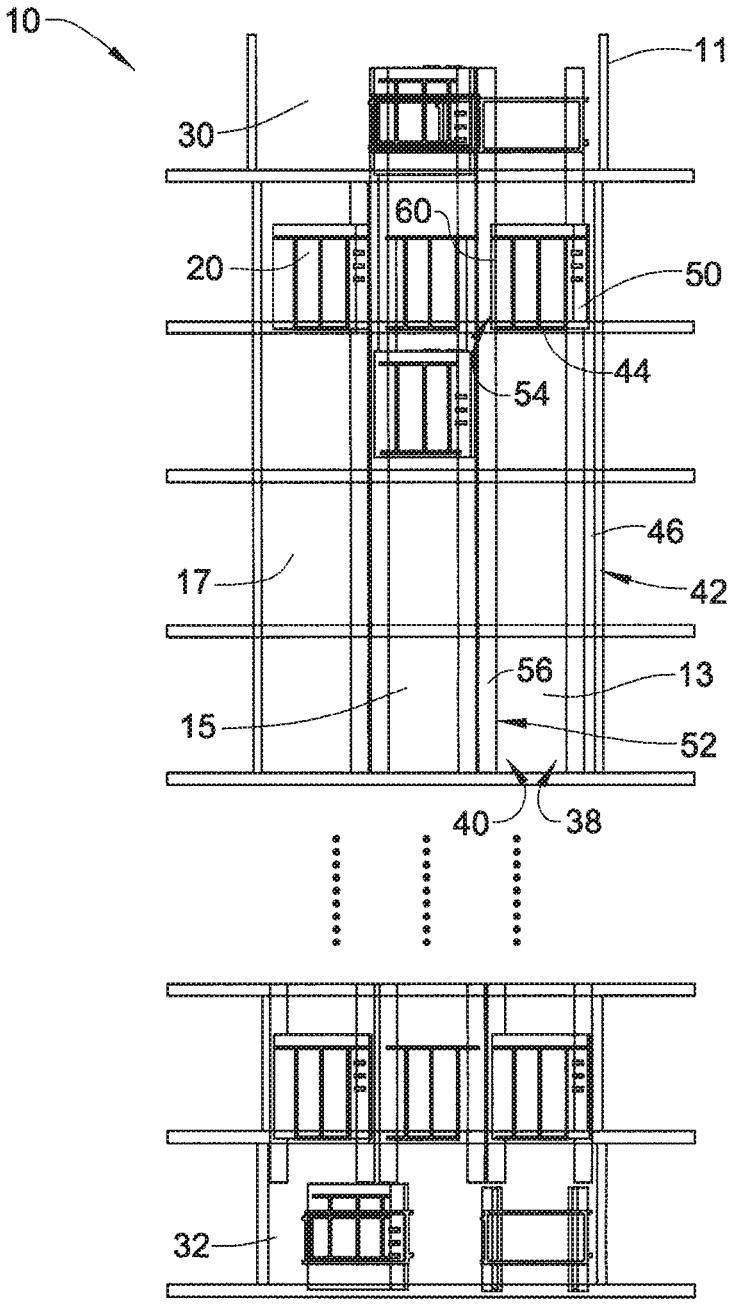
FIG. 1 depicts a multi-car ropeless elevator system including a position sensing system, in accordance with an exemplary embodiment.

FIG. 1 depicts a multi-car, ropeless elevator system 10 in an exemplary embodiment. Elevator system 10 includes a hoistway 11 having a plurality of lanes 13, 15 and 17. While three lanes are shown in FIG. 1, it is understood that embodiments may be used with multi-car, ropeless elevator systems having any number of lanes. In each lane 13, 15, 17, one or more cars 20 travel in one direction, i.e., up or down. For example, in FIG. 1 cars 20 in lanes 13 and 15 travel up and cars 20 in lane 17 travel down. One or more of cars 20 may travel in a single lane 13, 15 and 17.

Above a top floor (not separately labeled) is an upper transfer station 30 to impart horizontal motion to cars 20 between lanes 13, 15 and 17. It is understood that upper transfer station 30 may be located at the top floor, rather than above the top floor, or even below the top floor. Below a first floor (also not separately labeled) is a lower transfer station 32 to impart horizontal motion to cars 20 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32.

In for example lane 13, cars 20 may be propelled using a first plurality of linear motors 38 and a second plurality of linear motors 40. First plurality of linear motors 38 may be arranged along a first side wall (not separately labeled) of lane 13 and second plurality of linear motors 40 may be arranged on a second, opposing side wall (also not separately labeled) of lane 13. It should be understood that lanes 15 and 17 may be similarly arranged. It should also be understood that each lane 13, 15 and 17 may only include a single plurality of electric motors arranged along a side wall.

First plurality of linear motors 38 includes a primary, fixed portion 42 and a secondary, moving portion 44. Primary portion 42 includes windings or coils 46 mounted along the first side wall of lane 13. Secondary portion 44 may include permanent magnets 50 mounted to one side (not separately labeled) of car 20. Similarly, second plurality of linear motors 40 includes a primary, fixed portion 52 and a secondary, moving portion 54. Primary portion 52 includes windings or coils 56 mounted along the second side wall of lane 13. Secondary portion 54 may include permanent magnets 60 mounted to another side (not separately labeled) of car 20. Of course, it should be understood that one or more coils may be mounted on the car and magnets may be mounted along the lane.

Figure 2:
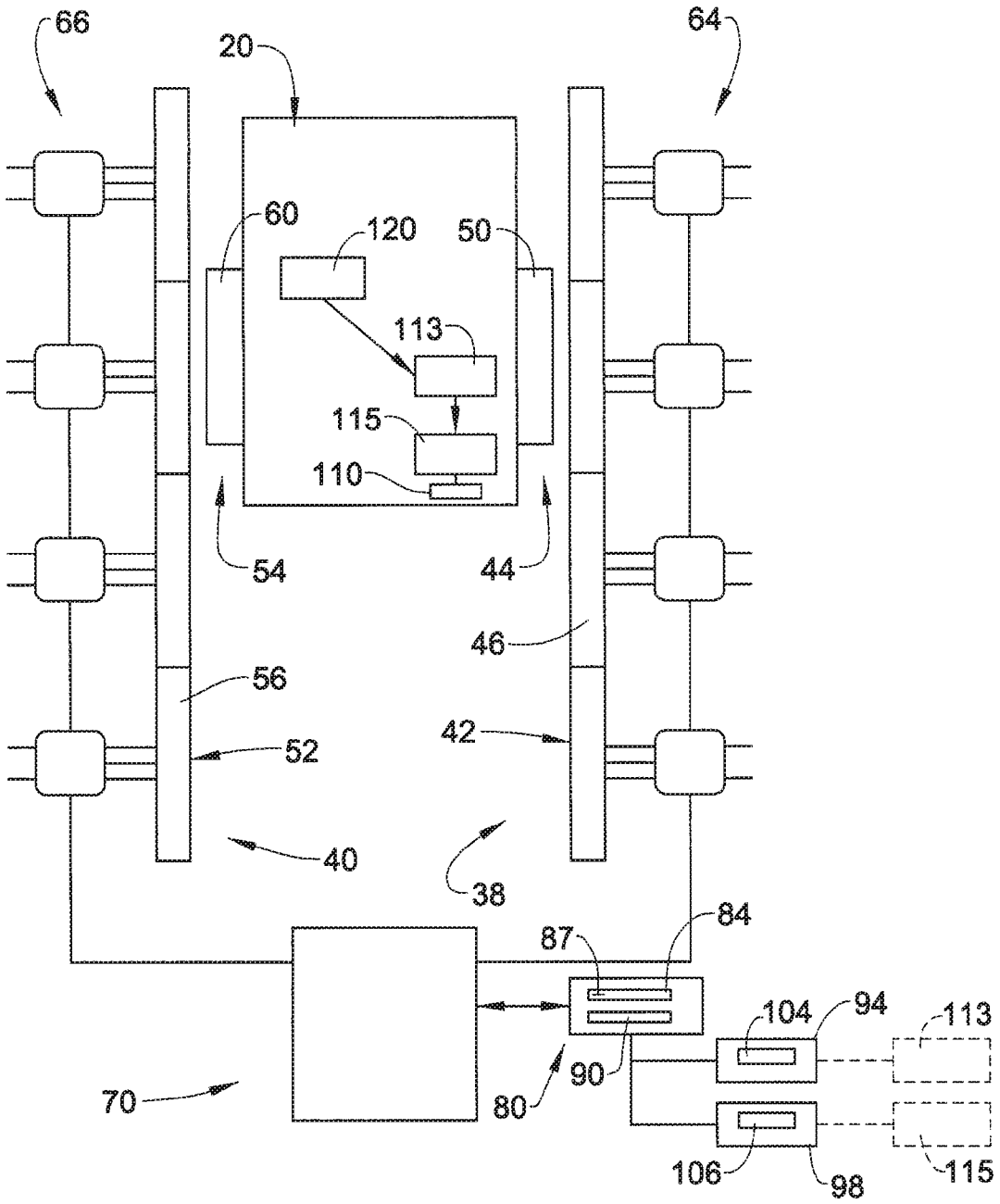
FIG. 2 depicts a portion of a drive system and control system for the multi-car ropeless elevator system of FIG. 1.

As shown in FIG. 2, each of the fixed portions 42 and 52 may be coupled to a corresponding one or more drives indicated at 64 and 66. Drives 64 and 66 are electrically coupled to a source of electricity (not shown) and supplied with drive signals from a linear motor controller 70 to control movement of cars 20 in their respective lanes. A lane controller 80 is operatively connected to linear motor controller 70. Lane controller 80 signals linear motor controller 70 to selectivity activate one or more of the first and second pluralities of linear motors 38 and 40 to move a car 20 to a selected position.

In accordance with an exemplary embodiment, lane controller 80 includes a back electro-motive force (EMF) module 84 which, in accordance with an aspect of an exemplary embodiment, may include a back EMF sensor 87 that detects back EMF from each of primary portions 42 and 52. At this point, it should be understood that back EMF sensor 84 may be arranged in linear motor controller 70, each of drives 64 and 66 or at each of primary portions 42 and 52. Further, back EMF module 84 may be a separate component or could form part of linear motor controller 70. Regardless of location, lane controller 80 may determine a position of each car 20, in for example lane 13 based on back EMF signals from one or more of primary portions 42, 52 perceived by back EMF sensor 84. It should be understood that each lane 13, 15 and 17 may include one or more lane controllers.

In accordance with another aspect of an exemplary embodiment, back EMF module 84 does not directly sense back EMF but rather determines an estimated back EMF signal. More specifically, back EMF module 84 receives current and voltage signals from linear motor controller 70. Based on measured current and drive voltage, back EMF module 84 calculates an estimated back EMF signal. The estimated back EMF signal is passed to lane controller 80 which may then determine a position of each car 20, in for example lane 13 based on an estimated back EMF signal from one or more of primary portions 42, 52 perceived by back EMF module 84.

Lane controller 80 may also include a car manager 90 that monitors back EMF signals from each of primary portions 42 and 52. Car manager 90 monitors anomalous or atypical back EMF signals that could represent an anomalous or atypical operation of one of more of cars 20. For example, back EMF signals having an atypical signal pattern could indicate that a car 20 is moving at an atypical speed. Car manager 90 may also determine whether a car 20 is in a non-predicted location. In either case, car manager 90 may determine that corrective action is desirable.

In further accordance with an exemplary embodiment, lane controller 80 may be operatively connected to a stop controller 94 and a car controller 98. Stop controller 94 may include a wireless communication system 104 for wirelessly communicating with each car 20 in lane 13. Similarly, car controller 98 may include a wireless communication system 106 for wirelessly communicating with each car 20 in lane 13. As will be detailed more fully below. Stop controller 94 may signal one or more cars 20 in lane 13 to stop in the event an atypical operation is detected. Car controller 98 may signal each car 20 to stop at a selected floor.

In still further accordance with an exemplary embodiment, each car 20 may include a brake 110, a brake manager 113, and a brake controller 115. Brake controller 115 is operatively connected to brake 110 and brake manager 113. Brake manager 113 is also coupled with stop controller 94. In accordance with an aspect of an exemplary embodiment, brake manager 113 may be coupled to stop controller 94 through wireless communication system 104. Of course, it should be understood that brake manager 113 may be directly connected to stop controller 94. Brake controller 115 is also coupled, through wireless communication system 106, with car controller 98. In addition, each car 20 may include a velocity sensor 120 that is operably connected to brake manager 113.

Brake 110 is selectively deployed to stop car 20 at some position along lane 13. For example, upon receiving a call, lane controller 80 may signal linear motor controller 70 to shift one of cars 20 to a selected floor. Lane controller 80 receives position feedback from back EMF module 84. When car 20 nears the selected floor, car controller 98 signals brake controller 115 to enter a stop mode. Brake controller 115 deploy brake 110 after determining a velocity of car 20, as sensed through the back EMF signal or a signal provided by velocity sensor 120, has reached a selected velocity threshold. In this manner, car 20 may be slowed to a stop without exposing occupants in car 20 to undesirable forces. In accordance with an aspect of an exemplary embodiment, the velocity threshold is higher than a back EMF cut-off threshold. More specifically, as car 20 slows, back EMF produced by primary portions 42 and 52 drops. At some point, above a zero velocity threshold, back EMF no longer exists. Accordingly, brake controller 115 will deploy brake 110 when car 20 is traveling at a non-zero velocity value that is higher than the back EMF cut-off value. In this manner, lane controller 80 continuously monitors a position of each car 20.

In accordance with another aspect of an exemplary embodiment, lane controller 80 also monitors back EMF module 84 for signals that could represent anomalous or atypical operation of a car 20. Upon determining an atypical operation exists, stop controller 94 signals linear motor controller 70 and brake manager 113 to enter a start mode for one or more of cars 20 in lane 13. Linear motor controller 70 will receive position information from lane controller 80 and operate primary portions 42 and 52 to execute a stop. Brake manager 113 will signal brake controller 115 to deploy brake 110 once the velocity signal meets the selected velocity threshold. In addition to stopping a car exhibiting atypical operation, others of cars 20 in lane 13 may also be stopped, or moved away from, the stopped car depending upon a position of each car 20 in lane 13. Of course, it should be understood, that lane controllers in lanes 15 and 17 may also stop cars in the event of a sensed atypical operation.

In accordance with yet another aspect of an exemplary embodiment, brake manager 113 and/or brake controller 115 may initiate a braking operation in the event of an interruption of communications from lane controller 80. More specifically, in the event of a wireless signal interruption between stop controller 94 and brake manager 113 and/or car controller 98 and brake controller 115, lane controller 80 may signal linear motor controller 70 to stop one or more cars 20 in lane 13. Brake manager 113 enters a braking mode and signals brake manager 115 to bring car 20 to a stop once velocity sensor 120 indicates that the selected velocity threshold has been reached. Lane controller 80 may signal all cars 20 in lane 13 to stop, or only those cars that have experienced a loss of communication. Further, the loss of communication should be understood to include an interruption of one or more signals between lane controller 80 and one or more of cars 20.

At this point it should be understood that exemplary embodiments describe a system that employs back electromotive force (EMF) signals to determine position and operational parameters of one or more cars moving along a lane of a multi-car ropeless elevator system. In addition, the present invention institutes a braking operation in one or more of the cars if atypical observation is sensed based on back EMF signals perceived at a controller. Further, the exemplary embodiments describe a system for braking one or more cars moving along a lane of a multi-car ropeless elevator system in the event of a communication loss from a controller and one or more of the one or more cars.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A ropeless elevator system comprising:

lane;

one or more cars arranged in the lane;

at least one linear motor arranged along one of the lane and on the one or more cars;

at least one magnet arranged along the other of the lane and the one or more cars, the at least one magnet being responsive to the at least one linear motor;

a linear motor controller operatively connected to the at least one linear motor;

a lane controller operatively connected to the linear motor controller; and a back electro-motive force (EMF) module operatively connected to at least one of the linear motor controller and the lane controller, the lane controller being configured and disposed to control stopping of at least one of the one or more cars based on a back EMF signal from the at least one linear motor determined by the back EMF module.

2. The ropeless elevator system according to claim 1, wherein the lane controller is configured and disposed to determine a position of each of the one or more cars in the lane based on the back EMF signal.

3. The ropeless elevator system according to claim 2, wherein the lane controller includes a car manager configured and disposed to determine an operational condition of each of the one or more cars based on the back EMF signal.

4. The ropeless elevator system according to claim 3, further comprising: a stop controller operatively connected to the lane controller, the stop manager being configured and disposed to control movement of each of the one or more cars based on the operational condition.

5. The ropeless elevator system according to claim 4, wherein each of the one or more cars includes a brake and a brake manager operatively connected to the stop manager, the stop manager being configured and disposed to signal the brake manager to deploy the brake based on the operational condition.

6. The ropeless elevator system according to claim 5, wherein the stop manager includes a wireless communication system configured to wirelessly communicate with the brake manager in each of the one or more cars.

7. The ropeless elevator system according to claim 6, wherein the brake manager is configured and disposed to deploy the brake in the event of a loss of communication with the lane controller.

8. The ropeless elevator system according to claim 4, further comprising: a velocity sensor arranged in each of the one or more cars, the brake manager being configured and disposed to deploy the brake based on a velocity signal from the velocity sensor.

9. The ropeless elevator system according to claim 4, further comprising: a car controller operatively connected to the lane controller and the brake manager, the car controller being configured and disposed to signal the brake manager to deploy the brake.

10. The ropeless elevator system according to claim 9, wherein the car controller includes a wireless communication system configured to wirelessly communicate with the brake controller.

11. The ropeless elevator system according to claim 1, wherein the back EMF module includes a sensor for detecting back EMF from one or more of the plurality of linear motors.

12. A method of controlling a ropeless elevator system comprising:

determining a back electro-motive force (EMF) signal from at least one linear motor arranged along one of an elevator lane and on an elevator car; and stopping the elevator car in the lane based on the back EMF signal.

13. The method of claim 12, further comprising: determining a position of the car in the lane based on the back EMF signal.

14. The method of claim 12, wherein stopping the car includes issuing a stop command from one of a stop controller and a car controller of a lane controller.

15. The method of claim 12, wherein determining a back EMF signal includes sensing a back EMF signal from one or more of the plurality of linear motors.

16. A method of controlling a ropeless elevator system comprising:

determining a back electro-motive force (EMF) signal from at least one linear motor arranged along one of an elevator lane and on an elevator car;

stopping the elevator car in the lane based on the back EMF signal; and stopping the car in the lane upon detecting a signal interruption between a lane controller and the car.

17. The method of claim 16, wherein detecting the signal interruption includes detecting a signal interruption from one of the stop controller and the car controller.

18. The method of claim 16, further comprising: deploying a brake upon receiving a velocity signal that is higher than a back EMF cut-off velocity.

* * * * *